United States Patent [19]

Mielcarek et al.

[11] Patent Number: 4,676,173

[45] Date of Patent: Jun. 30, 1987

[54] BOGIE FOR RAIL VEHICLES

[75] Inventors: Andreas Mielcarek, Schwabhausen; Karl-Heinz Buchholz, Nürnberg, both of Fed. Rep. of Germany

[73] Assignee: M.A.N Maschinenfabrik, Nürnberg, Fed. Rep. of Germany

[21] Appl. No.: 786,351

[22] Filed: Oct. 10, 1985

Related U.S. Application Data

[63] Continuation of Ser. No. 505,764, Jun. 20, 1983, abandoned.

[30] Foreign Application Priority Data

Jun. 26, 1982 [DE] Fed. Rep. of Germany ..... 3223989

[51] Int. Cl.[4] ..... B61F 5/52; B61C 15/00

[52] U.S. Cl. ..... 105/209; 105/77; 105/182.1

[58] Field of Search ..... 105/77, 182 R, 224 R, 105/224 A, 224.1, 167, 168, 209

[56] References Cited

U.S. PATENT DOCUMENTS

| | | | |
|---|---|---|---|
| 3,723,795 | 3/1973 | Baermann | 105/77 X |
| 3,988,992 | 11/1976 | Schindehütte | 105/182 R X |
| 4,003,316 | 1/1977 | Monselle | 105/224 R X |
| 4,030,424 | 6/1977 | Garner et al. | 105/182 R |
| 4,173,933 | 11/1979 | Kayserling | 105/182 R |
| 4,332,201 | 6/1982 | Pollard et al. | 105/182 R X |
| 4,434,719 | 3/1984 | McKosh, Jr. | 105/182 R X |
| 4,448,131 | 5/1984 | Weiland et al. | 105/182 R |

*Primary Examiner*—Randolph A. Reese
*Assistant Examiner*—David F. Hubbuch
*Attorney, Agent, or Firm*—Felfe & Lynch

[57] ABSTRACT

A bogie for a rail vehicle having a load bearing frame for supporting the vehicle from axle boxes on wheel sets has an integral coupling member connecting the axle boxes on one wheel set with the axle boxes on the other wheel set. The integral coupling member has an amount of inherent spring and/or damping properties effective for providing stable running characteristics to the bogie. Preferably, the integral coupling member has two, circularly curved portions between pairs of axle boxes on the wheel sets and transverse braces centrally therebetween.

8 Claims, 4 Drawing Figures

BOGIE FOR RAIL VEHICLES

This application is a continuation of application Ser. No. 505,764, filed June 20, 1983, now abandoned.

It is known to couple the wheel sets of load-bearing or rail trunks to improve running behavior. To this end, a coupling system was provided in addition to the load-bearing frame, the coupling system consisting of two Vee-shaped parts which were rigidly connected to the axle boxes and which were interconnected at the centre of the bogie by a flexible unit. This provided a clear segregation between the load-bearing parts and the elements for wheel set guidance. This permitted the primary suspension to be designed according to criteria of riding quality, since guidance of the wheel sets was provided by the additional system provided to interconnect the wheel sets. As a result, it was possible to make the primary suspension relatively soft without uncontrollable running conditions being obtained in consequence of excessive softness. A drawback was in the insufficient connection of the system at the bogie centre which did not permit any pre-determined coupling of the wheel sets (German Pat. No. 29 20 114).

In contrast to this, the present invention has for its object further improving a bogie so that stable running up to highest speed is possible without the risk of derailing due to uncontrollable motions of the load-bearing frame relative to the axle boxes in consequence of excessively soft coupling between said components.

This object is achieved by having the coupling system formed as an integral member which possesses an effective amount of inherent spring and/or damping properties due to its shape and/or its material for wheel set guidance as so that no additional elements are required for this.

The construction of the coupling system as an integral component makes it possible to unite the spring and damping properties in one unit and to design said properties freely to suit requirements independently of the requirement of the load-carrying component for strength, its properties thus not being arbitrarily variable. The coupling system according to the invention, however, makes it possible at the same time to provide soft primary suspension in the longitudinal and/or transverse directions without detriment to derailing safety because, in spite of the soft spring characteristics of the primary springs, the wheel sets are reliably guided with respect to each other by the coupling system.

An advantageous embodiment of the invention consists in forming the coupling frame as a hollow box section, providing two solebars, i.e. sidebars, symmetrically relative to the longitudinal centre plane of the bogie which are connected in the area of the bogie centre and the wheel sets by two transverse braces and in that the solebars are circularly curved and, at their ends, coupled to the wheel sets.

The special shape and selection of the materials make it possible to impart to the coupling system desired spring action and damping properties while simultaneously ensuring freedom from wear.

A typical embodiment of a bogie with a coupling frame can be seen in the drawings in which FIG. 1 is a side view of a carrying bogie partly in section along line I—I in FIG. 2.

Figure 1:
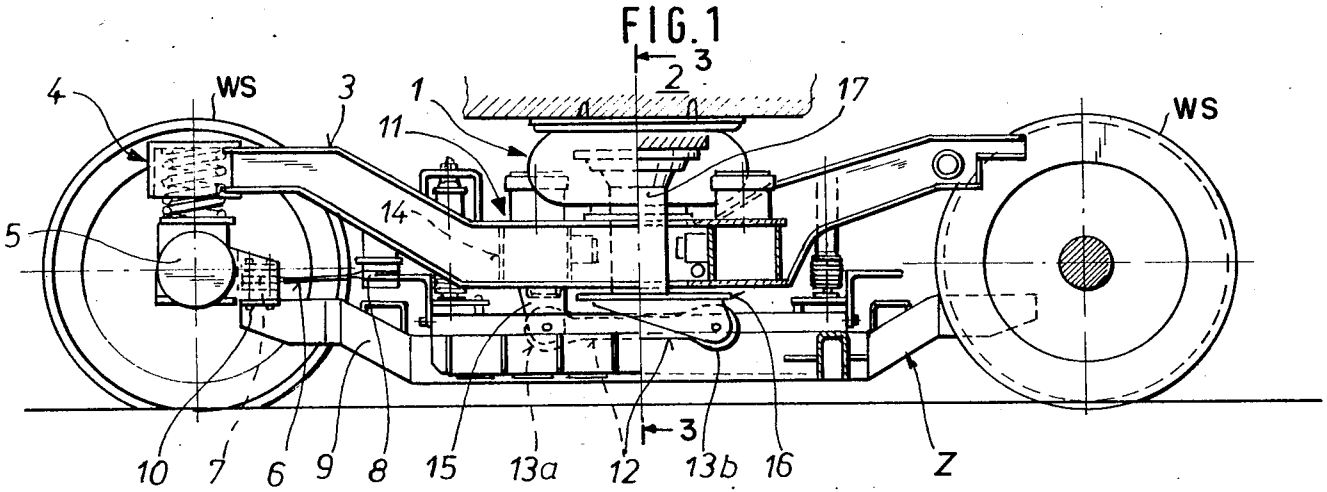
Figure 2:
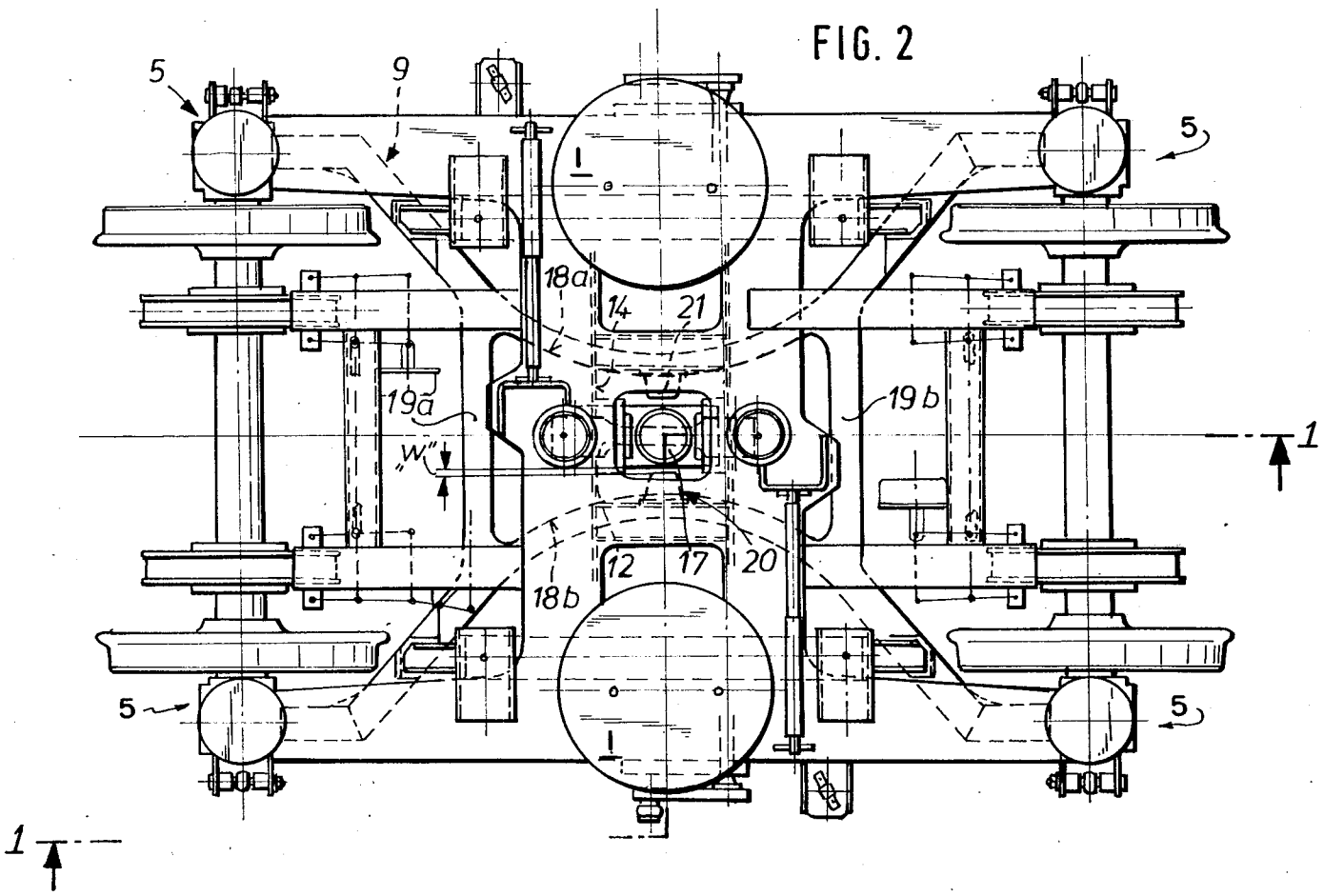
FIG. 2 is a plan view of the carrying bogie of FIG. 1.

A carrying bogie for a high-speed rail vehicle is shown in FIGS. 1 and 2. The carrying bogie is sprung by air springs 1 as secondary suspension against a car body 2 (FIG. 1) which is not shown in detail. Each air spring 1 bears on a swan-neck-shaped bogie solebar 3. Each end of each solebar is supported via a parimy spring 4 (only one shown in FIG. 1) on an axle box 5 of a wheel set W5. The axle boxes in turn are each flexibly connected by a spring-leak-link 6 to the bogie solebar 3, the connection of the axle box 5 to the spring leaf link 6 being effected flexibly by rubber elements 7, whereas the connection to the bogie solebar 3 is rigid by a serrated joint 8. Whereas the spring constants in the longitudinal and/or transverse direction of the guidance of the axle boxes 5 is in the conventional manner solely by the special design of the spring-leaf links 6 and the connecting elements at their ends, the arrangement according to the invention provides an additional interconnection of the wheel sets in as much as the axle boxes 5 are coupled by a coupling frame 9 of special shape and dimensioning so that the stability limit or limiting speed is influenced in a manner which is not afforded by the conventional guiding arrangement of the wheel sets.

In a version which is not shown in the drawing, it is possible to couple the coupling frame 9 to additional bearing casings surrounding the wheel set axle, if it should not be possible for reasons of physical design to connect the coupling frame 9 to the axle boxes.

Therefore, as may be seen particularly in FIG. 2, the two wheels sets of the bogie are placed apart longitudinally relative to the direction of vehicle movement, with one wheel of each wheel set located on the same lateral side of the bogie. There is a longitudinal central axis of the bogie which bisects each wheel set and a transverse axis, midway between the two wheel sets, perpendicular to the longitudinal axis. The intersection of the two axes defines the bogie center.

The coupling frame 9 is designed as a hollow box section and is rigidly connected to the axle boxes 5 by means of screws or bolts 10. By selecting in the known way the material shaping and dimensioning of the hollow box section, the spring constants of the coupling system is variable within wide limits and capable of being matched to the inter-connected masses. Furthermore, the coupling system is completely non-wearing and maintenance-free because there are no movable parts. The connection of a bogie frame 11 to the car body 2 is in a manner known per se by a link which is formed as a short link 12 and which is connected by rubber joints 13*a* and 13*b* both to a transverse member 14 via a second bracket 15 as well as, at its other end, via a first bracket 16 to a pivot 17 of the car body 2.

The primary suspension, consisting of the initially mentioned primary spring 4 and the rubber element 7 which is kinematically connected in series, can be constructed both in the longitudinal direction and in the transverse direction with a spring stiffness $c_p < 2.0 \times 10^6$ N/m, because the mutual guidance of the wheel sets for derailing safety is ensured by the coupling frame 9.

FIG. 2 shows the carrying bogie with the coupling frame 9 in plan. The coupling frame 9 directly interconnects the axle boxes 5. The coupling frame 9 is made up of two solebars 18*a* and 18*b* arranged symmetrically to the longitudinal plane of the bogie and which are circularly curved. Each solebar is rigidly connected at its opposite ends to the axle boxes of the two different wheel sets, respectively, on the same side of the bogie. As may be seen in FIG. 2, the solebars are spaced transversely with respect to each other at their central portions about the longitudinal axis of the bogie. The solebars 18*a* and 18*b* are interconnected by transverse braces 19*a* and 19*b* arranged symmetrically to the transverse plane. Positioned in the travelling direction in the longitudinal central plane, there is the short link 12 which, via the pivot 17, connects the superimposed car body 2 (FIG. 1) to the transverse member 14 of the bogie which transmits draw or draft and buffing forces without unduly interfering with the lateral flexibility and turning ability of the bogie. The transverse play of the bogie is determined by stops 20 which are fitted with rubber buffers 21 and surround the pivot 17 with a clearance "w".

Figure 3:
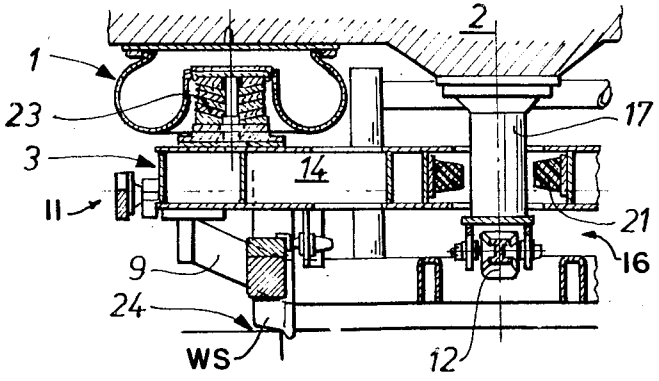
FIG. 3 is a partial section along the line III—III in FIG. 1.

A section through one bogie half in the transverse central plane is shown by FIG. 3. The car body 2 is supported bia the air spring 1 and an additional/emergency spring 23 on the bogie solebar 3. The bogie solebar 3 is connected by the transverse member 14 with the opposite solebar. At the centre of the bogie, the car body 2 is connected by the pivot 17 and the link 12 to the transverse member 14 to transmit draw and buffing forces. Side swing or lateral motion is controlled by the rubber buffers 21. The coupling frame 9 which flexibly interconnects the axle boxes 5 is positioned at a level between the top of the rail 24 and the transverse member 14.

As regards the physical design of the coupling frame 9, the drawing shows only one of many variants. The coupling frame could also be designed as a plate made of a fibre-reinforced plastic.

Figure 4:
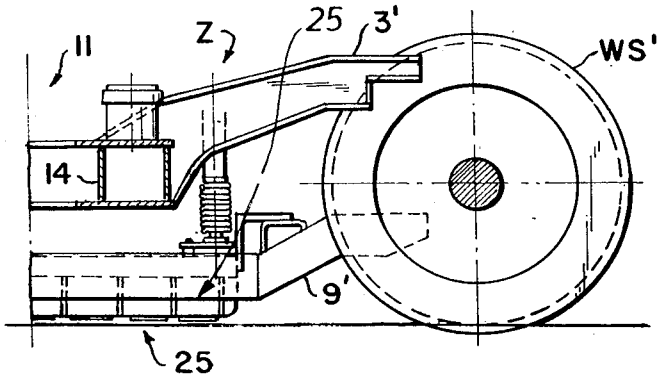
FIG. 4 is a side view of a portion like the detail Z in FIG. 1 of another embodiment with an eddy current brake.

As an additional brake for emergencies, an eddy current braking device 25 is envisaged which is shown as detail "z" from FIG. 1 in FIG. 4.

For a better understanding of the physical interrelationship, it may be explained that, due to the tapered threads of the wheels, the bogies of rail vehicles perform wave-like motions transverse to the track. Damping of these wave-like motions, also referred to as sinusoidal running, depends on the travelling speed and the amplitudes. In order to avoid running states which amplitudes of the motion which cause alternate wheel flange-to-rail contact which involves a high rate of wear and discomfort, the bogies have to be operated below their stability limit. The characteristics of an oscillating system are determined by the connecting elements of the masses which, in the case of a rail vehicle, are the primary and secondary restraining elements. By changing the arrangement or the parameters of the connecting elements, it is possible to influence the limit speed, i.e. the travelling speed associated with the stability limit. The governing factor for the effect of the elements is how the degrees of displacement freedom of the wheel sets are coupled. In a conventional primary restraint system, the degrees of freedom of the two wheel sets are coupled by the bogie frame and coupling stiffnesses can be indicated by $$C_S^* = \frac{d^2/4 \cdot C_x C_y}{a^2/4C_y + d^2/4C_x}$$

-continued $$C_B^* = d^2/4 \cdot C_x$$

where $C_x$=stiffness of the axle box connection in the longitudinal direction $C_y$=stiffness of the axle box connection in the transverse direction a=wheel base d=supporting base of axle box connection.

It has been found, however, that it is not possible to achieve any stiffness $C_s^*$ with conventional restraint. This is because $$C^*_B/C^*_S = a^2/4 + d^2/4 \cdot C_x/C_y$$

so that conventionally only $$C^*_B/C_S^* > a^2/4$$

can be set. In order to cover the complete range of parameters, it is a feature of the invention to provide additional direct coupling of the wheel sets by the additional frame. This makes it possible to realize bogie designs for optimum stability which are not possible with conventional wheel set guiding systems without the use of additional coupling systems with the car body.

It will be understood that the specification and examples are illustrative but not limitative of the present invention and that other embodiments within the spirit and scope of the invention will suggest themselves to those skilled in the art.

What is claimed is:

1. In a bogie for a rail vehicle having two wheel sets spaced apart longitudinally relative to the direction of vehicle movement, one wheel of each wheel set being located on the same lateral side of the bogie, there being a longitudinal central axis bisecting each wheel set and a transverse axis midway between the two wheel sets, the intersection of the two axes defining the bogie center, at least two axle boxes on each of the wheel sets for supporting the rail vehicle from the wheel sets, the improvement comprising:

an integral coupling member made from such material, in such a shape and with such dimensions to provide an effective amount of inherent spring and damping properties for assuring stable running of the bogie in use, said integral coupling member comprising two symmetrically-arranged solebars, each rigidly connected at its opposite ends to the axle boxes of two different wheel sets, respectively, on the same side of the bogie, and being generally circularly curved over at least a central portion of its length between its ends, the solebars being spaced transversely with respect to each other at their central portions; and two transverse braces extending between the solebars, respectively, on opposite sides of the bogie center between the respective central portions and the ends of the solebars.

2. The bogie of claim 1, wherein the axle bores (5) to which the ends of the solebars (18*a*, 18*b*) are connected are distinct from the axle boxes to which the load-bearing frame is connected.

3. The bogie of claim 2, wherein the load-bearing frame has a spring stiffness $c_p$ in at least one of the longitudinal and transverse directions relative to the axles boxes to which it is connected of $c_p < 2 \times 10^6$ N/m.

4. The bogie of claim 3, and further comprising an eddy current braking device (25) supported on the integral coupling member.

5. The bogie of claim 2, and further comprising an eddy current braking device (25) supported on the integral coupling member.

6. The bogie of claim 1, wherein the load-bearing frame has a spring stiffness $c_p$ in at least one of the longitudinal and transverse directions relative to the axle boxes to which it is connected of $c_p < 2 \times 10^6$ N/m.

7. The bogie of claim 6, and further comprising an eddy current braking device (25) supported on the integral coupling member.

8. The bogie of claim 1, and further comprising an eddy current braking device (25) supported on the integral coupling member.

* * * * *